US011363853B2

(12) United States Patent
Oda

(10) Patent No.: US 11,363,853 B2
(45) **Date of Patent: *Jun. 21, 2022**

(54) SOLE STRUCTURE AND SHOE INCLUDING THE SAME

(71) Applicant: Mizuno Corporation, Osaka (JP)

(72) Inventor: Takao Oda, Osaka (JP)

(73) Assignee: Mizuno Corporation, Osaka (JP)

( * ) Notice: Subject to any disclaimer, the term of this patent is extended or adjusted under 35 U.S.C. 154(b) by 133 days.

This patent is subject to a terminal disclaimer.

(21) Appl. No.: 16/802,917

(22) Filed: Feb. 27, 2020

(65) Prior Publication Data

US 2020/0305542 A1 Oct. 1, 2020

(30) Foreign Application Priority Data

Mar. 27, 2019 (JP) ..... JP2019-059824

(51) Int. Cl.

| | |
|---|---|
| ***A43B 13/16*** | (2006.01) |
| ***A43B 13/14*** | (2006.01) |
| ***A43B 13/28*** | (2006.01) |
| ***A43B 3/10*** | (2006.01) |

(52) U.S. Cl.

CPC ..... *A43B 13/14* (2013.01); *A43B 3/108* (2013.01); *A43B 13/28* (2013.01)

(58) Field of Classification Search

CPC ..... A43B 13/14; A43B 13/16; A43B 7/14; A43B 3/246; A43B 3/26

USPC ..... 36/97, 144

See application file for complete search history.

(56) References Cited

U.S. PATENT DOCUMENTS

| | | | | |
|---|---|---|---|---|
| 2,269,815 A * | 1/1942 | Goodman | A43B 7/1465 | 36/143 |
| 3,424,166 A * | 1/1969 | Gibbons | A43B 7/14 | 36/142 |
| 3,686,777 A * | 8/1972 | Rosen | A43B 3/26 | 36/97 |
| 4,608,970 A * | 9/1986 | Marek | A43B 13/14 | 602/29 |
| 5,348,532 A * | 9/1994 | Prahl | A61F 5/0127 | 602/24 |
| 5,867,923 A * | 2/1999 | Lehneis | A43B 13/12 | 36/25 R |
| 6,226,901 B1 * | 5/2001 | Rosen | A43B 7/1465 | 36/159 |

(Continued)

FOREIGN PATENT DOCUMENTS

JP 2008517699 A 5/2008

*Primary Examiner* — Marie D Bays

(74) *Attorney, Agent, or Firm* — Troutman Pepper Hamilton Sanders, LLP; James E. Schutz; Korbin M. Blunck

(57) ABSTRACT

A sole structure 1 includes: a first sole portion including a first sole body and a first connecting portion provided behind the first sole body; a second sole portion disposed behind the first sole portion and including a second sole body and a second connecting portion provided in front of the second sole body; and a connecting shaft provided along a vertical direction to connect the first connecting portion and the second connecting portion together. Either one of the first sole portion or the second sole portion is turnable around the connecting shaft relative to the other one of the first sole portion or the second sole portion in a foot width direction.

14 Claims, 17 Drawing Sheets

(56) References Cited

U.S. PATENT DOCUMENTS

| | | | | |
|---|---|---|---|---|
| 6,708,426 | B2 * | 3/2004 | Erickson | A43B 1/0072 36/102 |
| 6,874,257 | B2 * | 4/2005 | Erickson | A43B 1/0072 36/103 |
| 7,143,529 | B2 * | 12/2006 | Robinson, Jr. | A43B 1/0072 36/127 |
| D560,882 | S | 2/2008 | Tvoua et al. | |
| D581,142 | S | 11/2008 | Tvoua et al. | |
| D584,884 | S | 1/2009 | Tvoua et al. | |
| 7,552,546 | B2 * | 6/2009 | Cockburn | A43B 3/108 36/11.5 |
| D595,485 | S | 7/2009 | Tvoua et al. | |
| D609,437 | S | 2/2010 | Tvoua et al. | |
| 7,654,014 | B1 * | 2/2010 | Moore | A43B 5/001 36/127 |
| 10,834,996 | B2 * | 11/2020 | James | A43B 5/0494 |
| 11,033,072 | B2 * | 6/2021 | Oda | A43B 13/141 |
| 2007/0251126 | A1 | 11/2007 | Tvoua et al. | |
| 2009/0307929 | A1 | 12/2009 | Tvoua et al. | |
| 2016/0044992 | A1 * | 2/2016 | Reinhardt | A43B 3/0052 36/88 |
| 2018/0343968 | A1 * | 12/2018 | James | A43B 13/14 |
| 2020/0093220 | A1 * | 3/2020 | Oda | A43B 3/26 |

* cited by examiner

SOLE STRUCTURE AND SHOE INCLUDING THE SAME

CROSS-REFERENCE TO RELATED APPLICATION

This application claims priority to Japanese Patent Application No. 2019-059824 filed on Mar. 27, 2019, the entire disclosure of which is incorporated by reference herein.

BACKGROUND

The present disclosure relates to a sole structure and a shoe including such a sole structure.

Sole structures such as those disclosed in, e.g., Japanese Translation of PCT International Application No. 2008-517699 have been suggested as sole structures for supporting a foot of a person who wears shoes (hereinafter referred to as a "wearer").

The sole structure disclosed in Japanese Translation of PCT International Application No. 2008-517699 includes a toe portion, an intermediate portion, and a heel portion. The intermediate portion has a plurality of openings passing therethrough in a vertical direction. The intermediate portion is resiliently flexible so that its length varies with the openings. Each of the toe portion and the heel portion is displaceable relative to the intermediate portion in the longitudinal direction (i.e., in the foot length direction). Such a configuration allows the wearer to adjust the size of a shoe including the sole structure.

SUMMARY

People's feet have not only different lengths but also different shapes in the foot width direction. For this reason, if shoes can accommodate various shapes of feet also in consideration of the differences in the shapes of the feet in the foot width direction, the wearer does not have to find shoes fitted to the shapes of the feet. This situation is convenient.

Thus, the deformable sole structure as disclosed in Japanese Translation of PCT International Application No. 2008-517699 may make it possible for the shoe to follow the shape of the wearer's foot.

However, the intermediate portion of the sole structure disclosed in Japanese

Translation of PCT International Application No. 2008-517699 is resilient. A restoring force is exerted on the sole structure such that even if the sole structure is deformed to follow the shape of the wearer's foot, the sole structure restores its original shape. This restoring force presses the wearer's foot through an upper, causing the wearer a discomfort.

In view of the foregoing background, it is therefore an object of the present disclosure to have a shoe fit to a wearer's foot and keep the wearer from experiencing a sense of pressure from the shoe.

To achieve the object, a first aspect of the present disclosure is directed to a sole structure for a shoe. The sole structure includes: a first sole portion including a first sole body and a first connecting portion provided behind the first sole body; a second sole portion disposed behind the first sole portion and including a second sole body and a second connecting portion provided in front of the second sole body; and a connecting shaft provided along a direction perpendicular to a surface of the first connecting portion so as to connect the first connecting portion and the second connecting portion together. Ether one of the first sole portion or the second sole portion is turnable around the connecting shaft relative to the other one of the first sole portion or the second sole portion in a foot width direction.

According to the first aspect, either one of the first or second sole portion is turnable around the connecting shaft relative to the other one in a foot width direction. Thus, if a wearer's foot has, for example, a shape that is curved in the foot width direction to a higher degree than the shape of the shoe, the first or second sole portion turns in accordance with the shape of the foot of the wearer when the wearer puts on the shoe. Thus, the sole structure follows the shape of the wearer's foot without any resistance. As a result, according to the first aspect, the shoe fits to the wearer's foot, and it becomes possible to keep the wearer from experiencing a sense of pressure from the shoe.

A second aspect of the present disclosure is an embodiment of the first aspect. In the second aspect, the sole structure further includes: a stopper mechanism configured to limit a turnable range around the connecting shaft by the first sole portion and the second sole portion coming into contact with each other.

According to the second aspect, since the sole structure includes the stopper mechanism configured to limit the turnable range of the first or second sole portion around the connecting shaft, the turnable range of the first or second sole portion turns is limited. This configuration stabilizes the shoe, thereby making it comfortable to wear the shoe. Further, since the stopper mechanism limits the turnable range by the first and second sole portions and coming into contact with each other, the sole structure has a simple configuration. As a result, according to the second aspect, such a simple configuration allows the wearer to comfortably wear the shoe.

A third aspect of the present disclosure is an embodiment of the first or second aspect. In the third aspect, at least one of the first connecting portion or the second connecting portion has a first elongate hole extending in a foot length direction, and the connecting shaft is slidably connected to the first elongate hole.

According to the third aspect, since the connecting shaft is slidably connected to the first elongate hole extending in the foot length direction, either one of the first or second sole portion is movable relative to the other one in the foot length direction. Thus, since the first sole portion or the second sole portion turns around the connecting shaft and moves in the foot length direction, the sole structure has a higher degree of freedom in movement and can follow the shape of the wearer's foot without any resistance. As a result, according to the third aspect, the shoe fits to the wearer's foot, and it becomes possible to keep the wearer from experiencing a sense of pressure from the shoe.

A fourth aspect of the present disclosure is an embodiment of any one of the first to third aspects. In the fourth aspect, at least one of the first connecting portion or the second connecting portion has a second elongate hole extending in the foot width direction, and the connecting shaft is slidably connected to the second elongate hole.

According to the fourth aspect, since the connecting shaft is slidably connected to the second elongate hole extending in the foot width direction, either one of the first or second sole portion is movable relative to the other one in the foot width direction. Thus, since the first sole portion or the second sole portion turns around the connecting shaft and moves in the foot width direction, the sole structure has a higher degree of freedom in movement and can follow the shape of the wearer's foot without any resistance. As a result, according to the fourth aspect, the shoe fits to the wearer's foot, and it becomes possible to keep the wearer from experiencing a sense of pressure from the shoe.

A fifth aspect of the present disclosure is an embodiment of the second aspect. In the fifth aspect, either one of the first connecting portion or the second connecting portion has a protrusion spaced apart from the connecting shaft in the foot width direction as viewed from above, the protrusion protruding vertically, the other one of the first connecting portion or the second connecting portion has a guide configured to guide the protrusion through turning of the first sole portion or the second sole portion, and the turnable range of the first sole portion or the second sole portion is limited by the protrusion coming into contact with one of both end portions of the guide.

According to the fifth aspect, the turning of the first or second sole portion allows the guide to guide the protrusion. Then, the protrusion comes into contact with one of both end portions of the guide. That is to say, the end portions of the guide are each come into contact with the protrusion and serve as a stopper, thus limiting the turnable range of the first or second sole portion. Thus, the fifth aspect is a specific embodiment of the stopper mechanism of the second aspect. The stopper mechanism stabilizes the shoe, thereby making it comfortable to wear the shoe. As a result, according to the fifth aspect, such a simple configuration allows the wearer to comfortably wear the shoe.

A sixth aspect of the present disclosure is an embodiment of any one of the first to fifth aspects. In the sixth aspect, the sole structure further includes: a first arm provided for the first connecting portion; and a second arm provided for the second connecting portion, wherein the connecting shaft includes a first connecting shaft, a second connecting shaft, and a third connecting shaft, one end portion of the first arm is connected to the first connecting portion to be turnable around the first connecting shaft, one end portion of the second arm is connected to the second connecting portion to be turnable around the second connecting shaft, the other end portion of the first arm and the other end portion of the second arm are connected together to be turnable around the third connecting shaft, and either one of the first sole portion or the second sole portion is turnable around the connecting shafts relative to the other one of the first sole portion or the second sole portion in the foot width direction, and is movable relative to the other one in the foot length direction.

According to the sixth aspect, the one end portion of the first arm is connected to the first connecting portion to be turnable around the first connecting shaft, and the one end portion of the second arm is connected to the second connecting portion to be turnable around the second connecting shaft. Furthermore, the other end portions of the first and second arms are connected together to be turnable around the third connecting shaft. Thus, either one of the first or second sole portion is turnable around the three connecting shafts relative to the other one. At least one of the turning of the first arm around the first connecting shaft, the turning of the second arm around the second connecting shaft, or the turning of the first and second arms around the third connecting shaft allows either one of the first or second sole portion to move relative to the other one in the foot length direction. As can be seen, the sole structure can be more freely deformed than a sole structure including a first or second sole portion turnable around only one connecting shaft. The sole structure therefore has a higher degree of freedom in movement and can follow the shape of the wearer's foot without any resistance. As a result, according to the sixth aspect, the shoe fits to the wearer's foot, and it becomes possible to keep the wearer from experiencing a sense of pressure from the shoe.

A seventh aspect of the present disclosure is an embodiment of any one of the first to sixth aspects. In the seventh aspect, the first connecting portion and the second connecting portion are connected together while overlapping each other in the vertical direction, and either one of the first sole portion or the second sole portion turns relative to the other one of the first sole portion or the second sole portion in the foot width direction while the first connecting portion and second connecting portion keep overlapping each other in the vertical direction.

According to the seventh aspect, the first or second sole portion turns while the first and second connecting portions keep overlapping each other in the vertical direction. Thus, even if either one of the first or second sole portion is turned relative to the other one in the foot width direction, clearance between the first and second sole portions is less likely to be formed. This configuration makes it difficult for foreign substances, water, or any other material to enter such clearance from the road surface or the ground. As a result, according to the seventh aspect, the wearer can safely and comfortably wear the shoe.

An eighth aspect of the present disclosure is directed to a shoe including the sole structure of any one of the first to seventh aspects.

According to the eighth aspect, shoes may be provided which provide similar advantages to those of the first to seventh aspects. As a result, according to the eighth aspect, the wearer can safely and comfortably wear the shoe which fits the wearer's foot and keeps the wearer from experiencing a sense of pressure.

As described above, according to the present disclosure, it is possible to make a shoe fit to a wearer's foot and keep the wearer from experiencing a sense of pressure from the shoe.

DETAILED DESCRIPTION

Embodiments of the present disclosure will now be described with reference to the drawings. Note that the following description of the embodiments is merely an example in nature, and is not intended to limit the scope, applications, or use of the present disclosure.

First Embodiment

Figure 1:
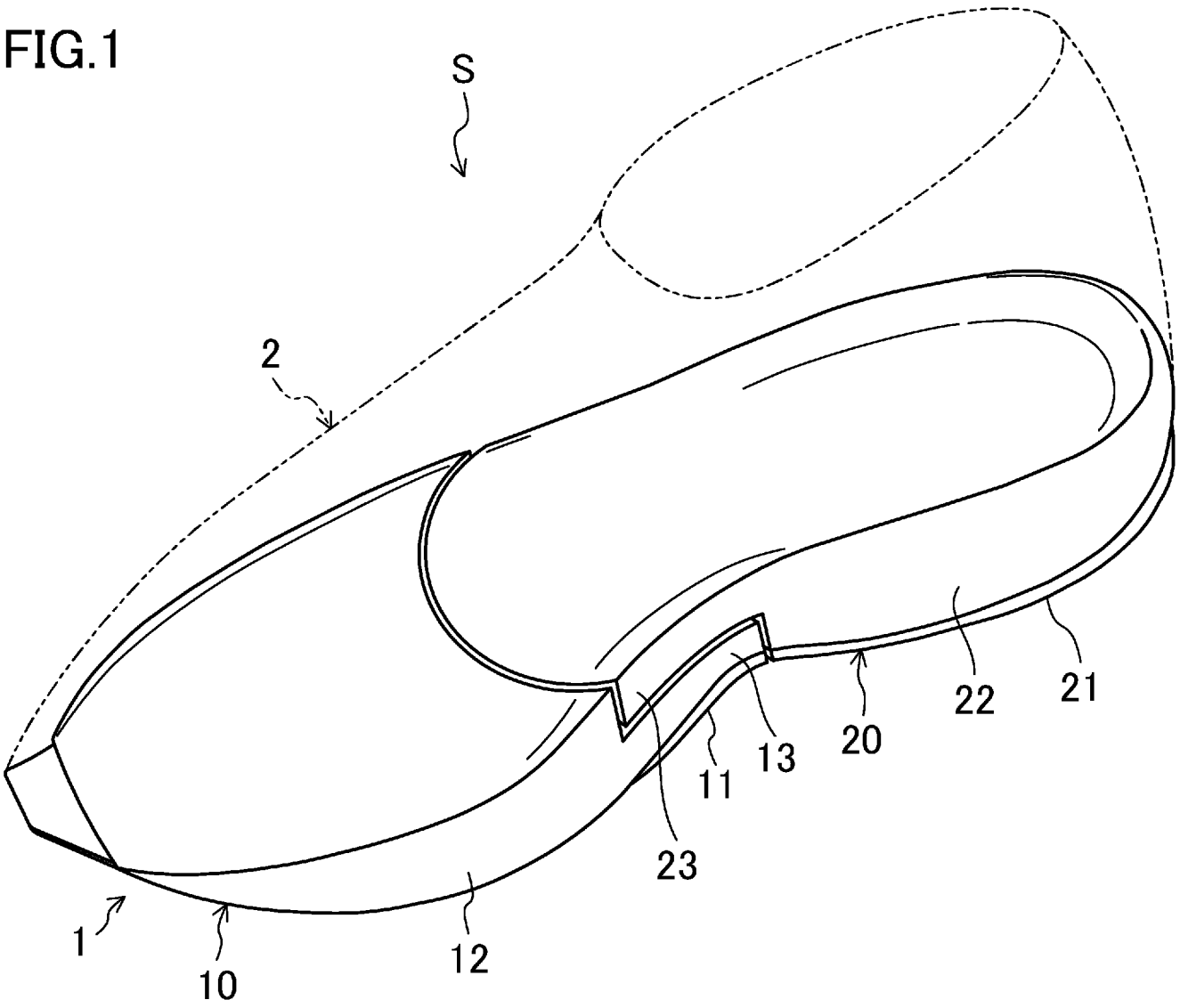
FIG. 1 is a perspective view showing an entire shoe including a sole structure according to a first embodiment.
Figure 2:
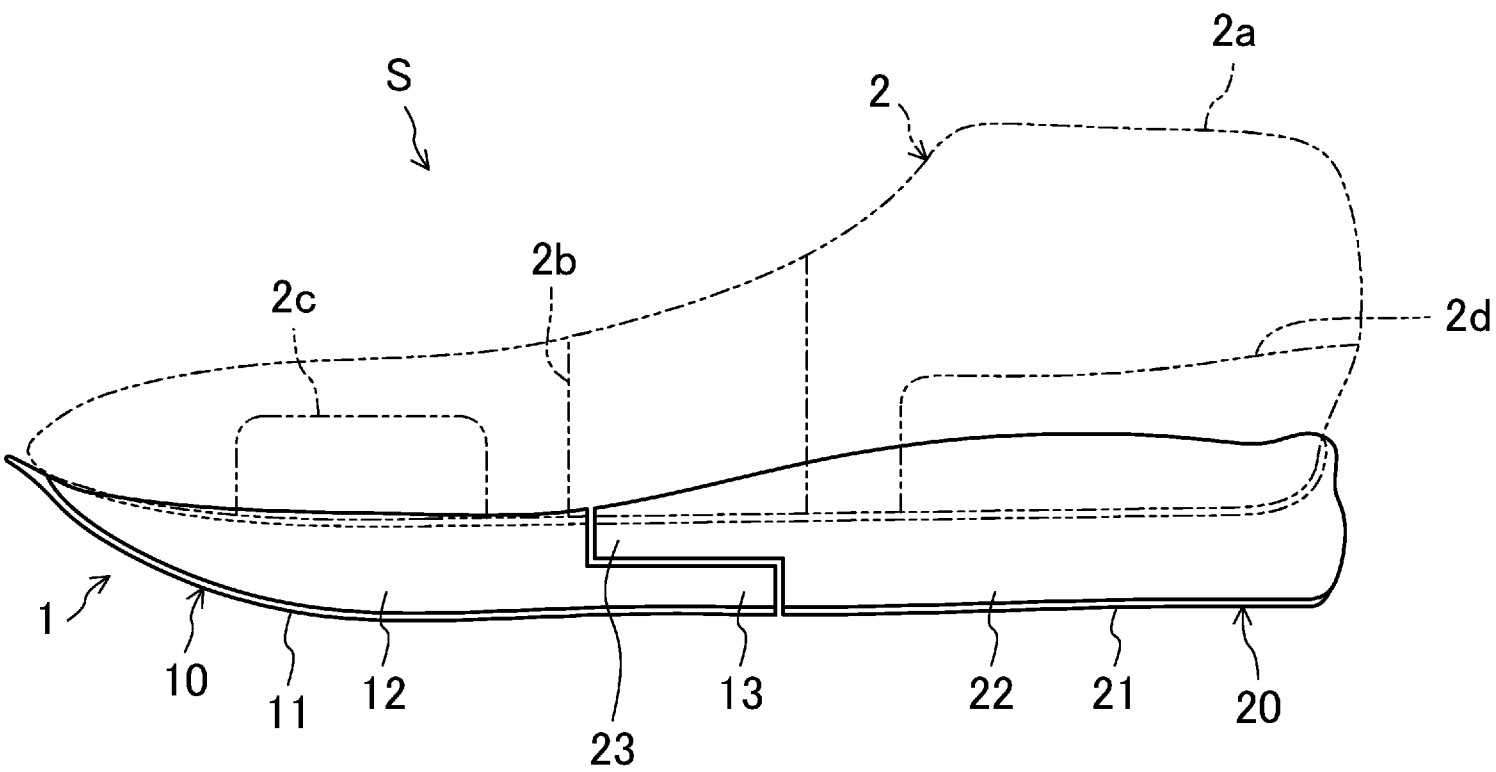
FIG. 2 is a side view of the shoe including the sole structure according to the first embodiment, as viewed from a medial side of the shoe.
Figure 3:
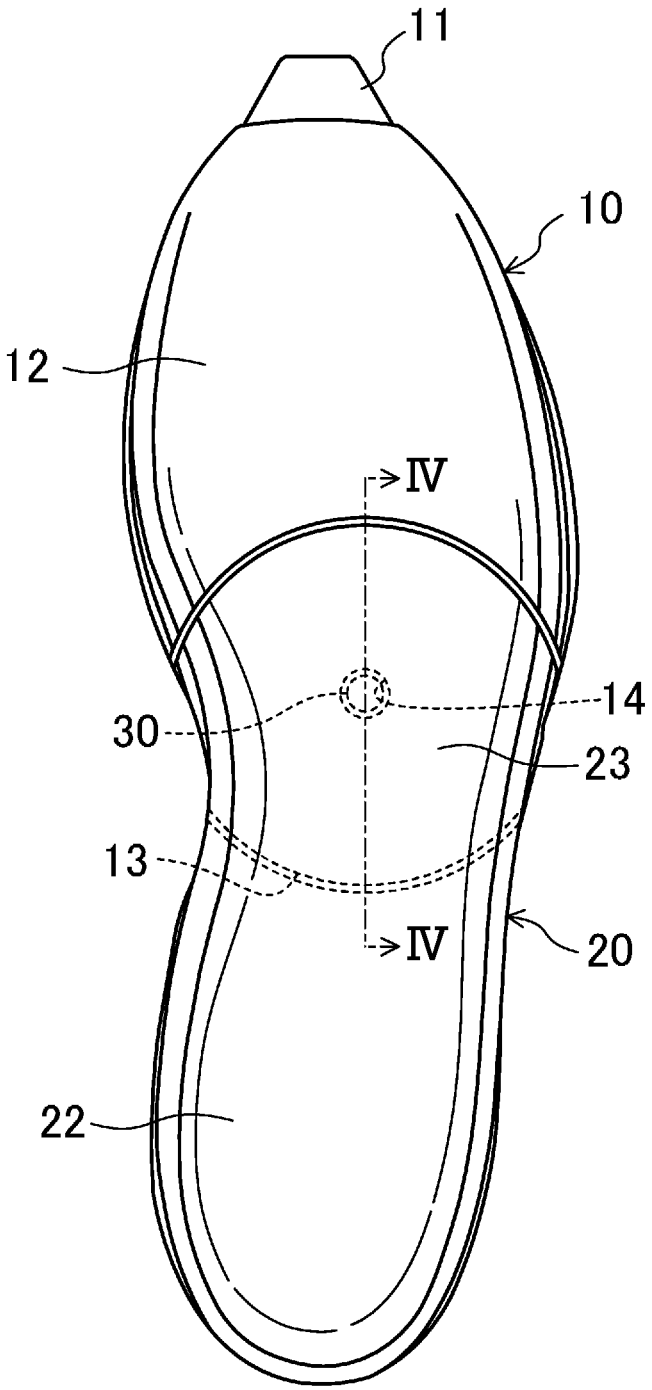
FIG. 3 is a plan view of the sole structure according to the first embodiment.

FIGS. 1 to 3 show a sole structure 1 according to a first embodiment of the present disclosure and a shoe S including the sole structure 1. A pair of shoes S may be used, for example, as athletic shoes for running and various sports, sneakers for daily use, or rehabilitation shoes.

The drawings illustrate a right shoe S only as an example. Since the left shoe is symmetrical to the right shoe, only the right shoe will be described in the following description, and the description of the left shoe will be omitted herein.

In the following description, the expressions "above," "upward," "on a/the top of," "below," "under," and "downward," represent the vertical positional relationship between respective components of the shoe S. The expressions "front," "fore," "forward," "anterior," "rear," "hind," "behind," "backward," and "posterior" represent the positional relationship in the foot length direction (the longitudinal direction) between respective components of the shoe S. The expressions "medial side (left side)" and "lateral side (right side)" represent the positional relationship in the foot width direction (the lateral direction) between respective components of the shoe S.

As shown in FIGS. 1 to 5, in this embodiment, the sole structure 1 has two members separate from each other in the foot length direction. Specifically, the sole structure 1 has a first sole portion 10 and a second sole portion 20.

First Sole Portion

The first sole portion 10 extends so as to correspond, for example, to an area, from forefoot to midfoot, of a foot of a person wearing the shoe S (hereinafter will be referred to as the "wearer").

The first sole portion 10 has a first outsole portion 11. The first outsole portion 11 is made of a hard elastic member, the hardness of which is greater than the hardness of a first sole body 12 and a first connecting portion 13, which will be described below. Specifically, non-limiting suitable examples of the material for the first outsole portion 11 include thermoplastic resins such as ethylene-vinyl acetate copolymer (EVA), thermosetting resins such as polyurethane (PU), and rubber materials such as butadiene rubber and chloroprene rubber.

The first sole portion 10 includes the first sole body 12. The first sole body 12 is stacked on the first outsole portion 11. The first sole body 12 is made of a soft elastic material. Specifically, non-limiting suitable examples of the material for the first sole body 12 include thermoplastic resins such as ethylene-vinyl acetate copolymer (EVA) and foams thereof, thermosetting resins such as polyurethane (PU) and foams thereof, and rubber materials such as butadiene rubber and chloroprene rubber and foams thereof.

An upper surface of the first sole body 12 is configured as a portion of a planta support surface configured to support an area of the wearer's planta from the forefoot to the midfoot.

As shown in FIGS. 1 to 5, the first sole portion 10 includes the first connecting portion 13. The first connecting portion 13 is made of the same material as the first sole body 12. Alternatively, the first connecting portion 13 may be made of a material different from that of the first sole body 12. The first connecting portion 13 is provided behind the first sole body 12. The first connecting portion 13 is integrated with the first sole body 12. The first connecting portion 13 is disposed under a second connecting portion 23, which will be described below. Just like the first sole body 12, the first connecting portion 13 is stacked on the first outsole portion 11.

The first connecting portion 13 has a smaller thickness than the first sole body 12. An upper surface of the first connecting portion 13 is not level with the upper surface of the first sole body 12, as viewed from side. Specifically, the upper surface of the first connecting portion 13 is positioned below the upper surface of the first sole body 12. A lower surface of the first connecting portion 13 is flush with a lower surface of the first sole body 12.

Figure 4:
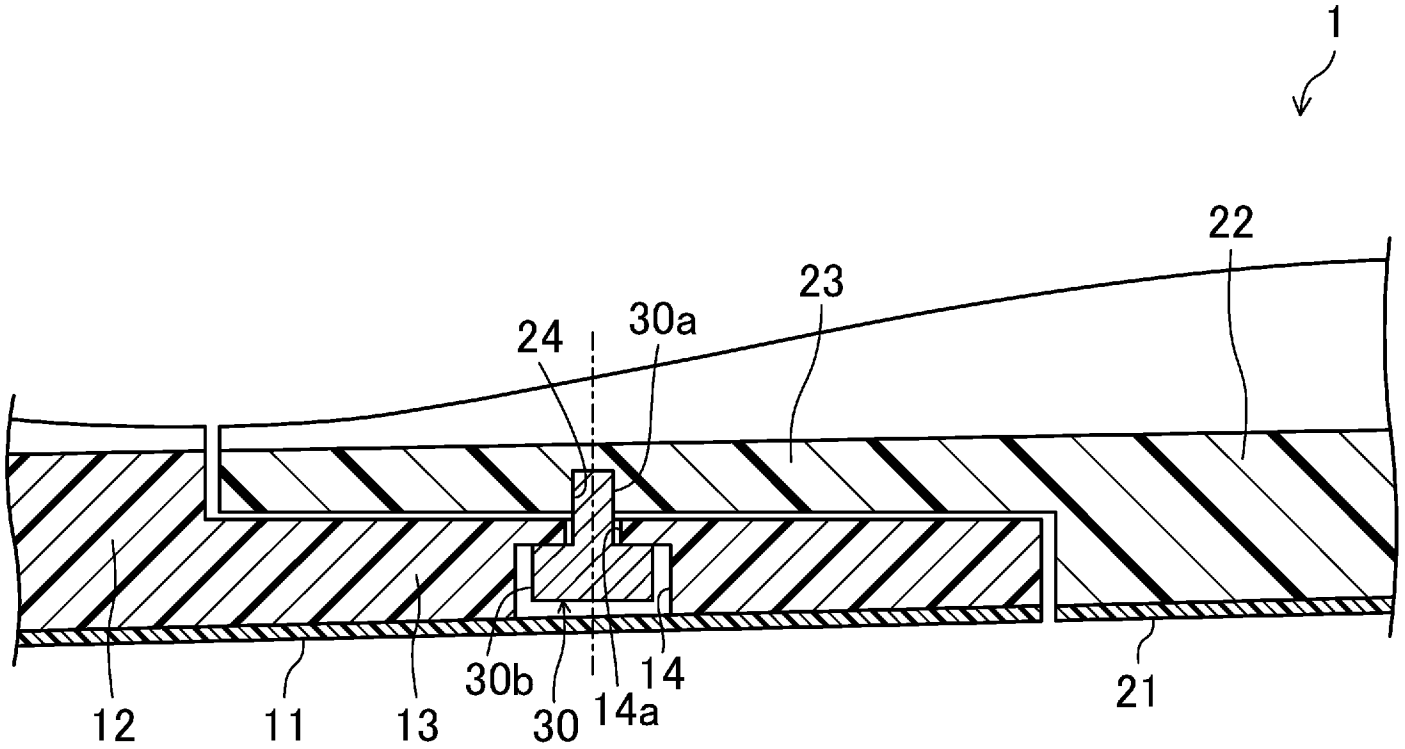
FIG. 4 is a cross-sectional view taken along line IV-IV shown in FIG. 3.
Figure 5:
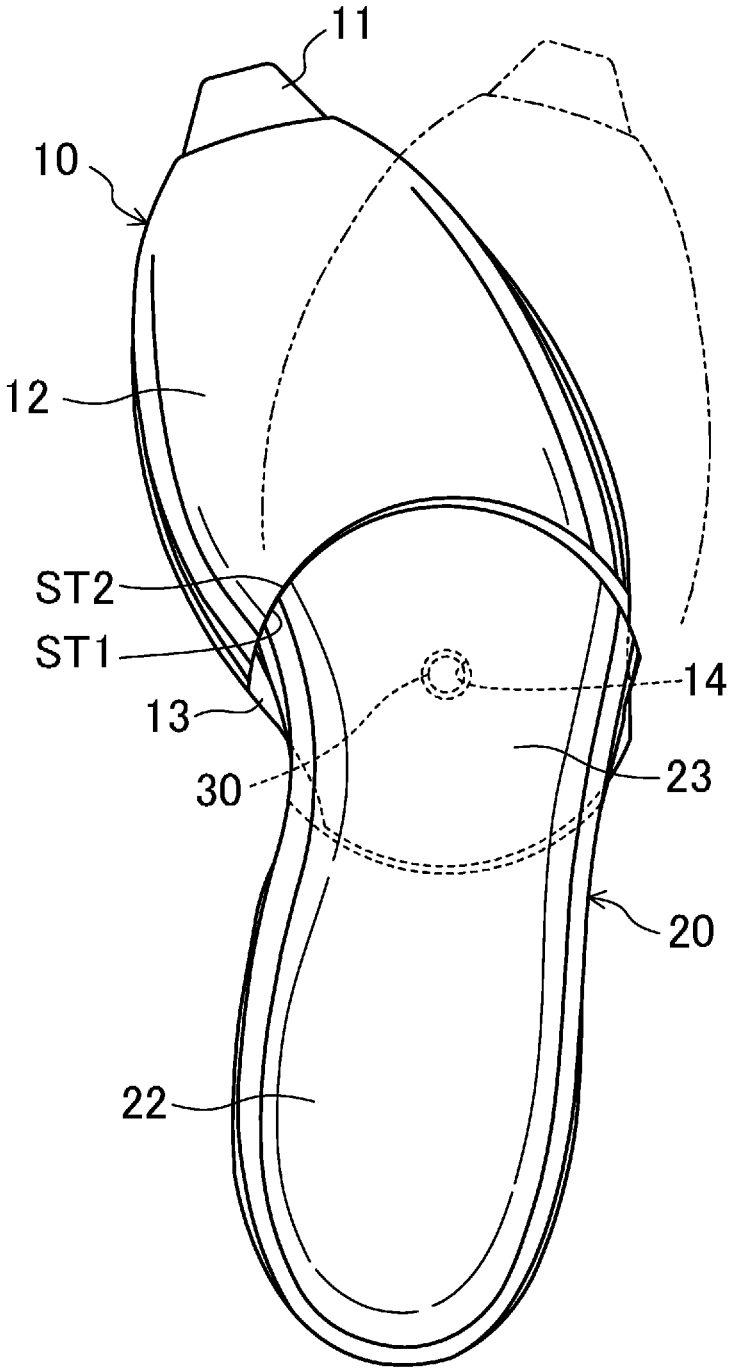
FIG. 5 is a plan view showing a state of the sole structure where a first sole portion of the sole structure turns relative to a second sole portion thereof in the foot width direction.

As shown in FIGS. 3 to 5, the first connecting portion 13 has a hole 14. The hole 14 is to be connected to a connecting shaft 30, which will be described below. The hole 14 passes through the first connecting portion 13 along the vertical direction. The hole 14 is formed through substantially the center of the first connecting portion 13. The hole 14 has a circular shape, as viewed from the bottom. The hole 14 is covered with the first outsole portion 11 from below (see FIG. 4).

The hole 14 has a narrower upper opening **14*a*. A shaft portion 30*a* of the connecting shaft 30, which will be described below, is inserted into, and run through, the upper opening 14*a* along the vertical direction. The upper opening 14*a* is located at substantially the center of the hole 14. The diameter of the upper opening 14*a* is larger than that of the shaft portion 30*a* of the connecting shaft 30, which will be described below. The diameter of the upper opening 14*a* is smaller than that of a retaining portion 30*b* of the connecting shaft 30**, which will be described below.

Second Sole Portion

As shown in FIGS. 1 to 5, the second sole portion 20 is disposed behind the first sole portion 10. The second sole portion 20 extends so as to correspond, for example, to an area from the midfoot to hindfoot of the wearer's foot.

The second sole portion 20 has a second outsole portion 21. Just like the first outsole portion 11, the second outsole portion 21 is made of a hard elastic member having great hardness. Note that the second outsole portion 21 may be made of the same material as the first outsole portion 11. Alternatively, the second outsole portion 21 may be made of a material different from that of the first outsole portion 11.

The second sole portion 20 includes a second sole body 22. Just like the first sole body 12, the second sole body 22 is made of a soft elastic material. Note that the second sole body 22 may be made of the same material as the first sole body 12. Alternatively, the second sole body 22 may be made of a material different from that of the first sole body 12.

The second sole body 22 is stacked on the second outsole portion 21. An upper surface of the second sole body 22 is configured as a portion of a planta support surface configured to support an area of the wearer's planta from the midfoot to the hindfoot.

The second sole portion 20 has a second connecting portion 23. The second connecting portion 23 is provided in front of the second sole body 22. The second connecting portion 23 is integrated with the second sole body 22. Note that the second connecting portion 23 may be made of the same material as the first connecting portion 13. Alternatively, the second connecting portion 23 may be made of a material different from that of the first connecting portion 13.

The second connecting portion 23 has a smaller thickness than the second sole body 22. There is a step between the lower surface of the second connecting portion 23 and the lower surface of the second sole body 22, as viewed from side. Specifically, the lower surface of the second connecting portion 23 is positioned above the lower surface of the second sole body 22. An upper surface of the second connecting portion 23 is flush with the upper surface of the first sole body 12 and the upper surface of the second sole body 22. That is to say, the upper surface of the second connecting portion 23 is configured as a portion of a planta support surface configured to support a portion of the wearer's planta.

As shown in FIG. 4, the second connecting portion 23 has a fixing hole 24. The fixing hole 24 extends upward from the lower surface of the second connecting portion 23 and has a closed end. The fixing hole 24 has a circular shape, as viewed from the bottom. The fixing hole 24 is formed at substantially the center of the second connecting portion 23.

Connecting Shaft

The sole structure 1 includes the connecting shaft 30. The connecting shaft 30 is used to connect the first and second connecting portions 13 and 23 together.

As shown in FIGS. 3 to 5, the connecting shaft 30 extends vertically at a position where the first and second connecting portions 13 and 23 overlap each other. As shown in FIG. 4, the connecting shaft 30 includes the shaft portion 30*a* and the retaining portion 30*b*.

The shaft portion 30*a* is formed in the shape of a pillar extending vertically. The shaft portion 30*a* is cylindrical. A lower portion of the shaft portion 30*a* is inserted into, and run through, the opening 14*a* of the hole 14 of the first connecting portion 13. An upper portion of the shaft portion 30*a* is fixed to the fixing hole 24 of the second connecting portion 23 with, for example, an adhesive.

The retaining portion 30*b* has substantially a disk-like shape, for example. The retaining portion 30*b* has a larger diameter than the shaft portion 30*a*. The retaining portion 30*b* is integrated with the shaft portion 30*a*. The retaining portion 30*b* is accommodated in the hole 14 in a state in which the shaft portion 30*a* is inserted into, and run through, the opening 14*a* of the hole 14. Further, an upper surface of the retaining portion 30*b* is in contact with a lower periphery of the opening 14*a* of the hole 14.

The first and second connecting portions 13 and 23 are connected together through the connecting shaft 30 while overlapping each other in the vertical direction. Specifically, the first and second connecting portions 13 and 23 are connected together such that the upper surface of the first connecting portion 13 and the lower surface of the second connecting portion 23 face each other in the vertical direction. Each of the first and second connecting portions 13 and 23 is configured to turn around the shaft portion 30*a* of the connecting shaft 30 in the foot width direction (see the solid line and the phantom line in FIG. 5).

Note that the upper surface of the first connecting portion 13 and the lower surface of the second connecting portion 23 may be in contact with each other. In such a contact state, lubricating oil or any other similar material is applied between the upper surface of the first connecting portion 13 and the lower surface of the second connecting portion 23 in one preferred embodiment. This lubricating oil can substantially prevent an excessive frictional force from being generated between the upper surface of the first connecting portion 13 and the lower surface of the second connecting portion 23.

Upper

As shown in FIGS. 1 and 2, the shoe S has an upper 2 that covers the wearer's foot. The upper 2 is attached to the sole structure 1. The upper 2 is configured as, for example, a knitted fabric, a woven fabric, a nonwoven fabric, a synthetic leather, an artificial leather, or a natural leather. An upper portion of the upper 2 has a foot insertion portion 2*a* into which the wearer's foot is to be inserted. As shown in FIG. 2, the upper 2 has a stretchable portion 2*a*, a first fixing portion 2*c*, and a second fixing portion 2*d*.

The stretchable portion 2*b* is a portion of the upper 2 corresponding to the first and second connecting portions 13 and 23 overlapping each other in the vertical direction.

The first fixing portion 2*c* is disposed forward of a portion of the upper 2 corresponding to the first connecting portion 13. The first fixing portion 2*c* is fixed to a peripheral portion of the first sole body 12 with a fastening member, such as a lace member, or an adhesive.

The second fixing portion 2*d* is disposed backward of a portion of the upper 2 corresponding to the second connecting portion 23. The second fixing portion 2*d* is fixed to a peripheral portion of the second sole body 22 with a fastening member, such as a lace member, or an adhesive.

Stopper Mechanism

As shown in FIG. 5, the sole structure 1 includes stopper mechanisms ST1 and ST2 which limit a turnable range of the first sole portion 10 or the second sole portion 20 around the connecting shaft 30 by the first and second sole portions 10 and 20 coming into contact with each other. Specifically, a rear end portion ST1 (a step-like portion) of the first sole body 12 and a front end portion ST2 of the second connecting portion 23 are configured to come into contact with each other while the first sole portion 10 turns. That is to say, the rear end portion ST1 of the first sole body 12 and the front end portion ST2 of the second connecting portion 23 respectively constitute the stopper mechanisms ST1 and ST2 limiting the turnable range of the first sole portion 10.

Sole Structure and Movements of Upper

Next, the sole structure 1 and movements of the upper 2 according to the first embodiment will be described.

In the state shown in FIG. 4, if the wearer's foot has, for example, a shape that is curved toward the medial side of the foot to a higher degree than the shape of the shoe S, the first fixing portion 2*c* of the upper 2 moves toward the medial side of the shoe S in accordance with the shape of the foot of the wearer when the wearer puts on the shoe S. Accordingly, an external force toward the medial side of the shoe S is transferred to the first sole body 12 via the upper 2. The external force allows the first sole portion 10 to turn toward the medial side around the connecting shaft 30 relative to the second sole portion 20 (see the solid line in FIG. 5).

As shown in FIG. 5, the sole structure 1 is configured such that the first sole portion 10 turns relative to the second sole portion 20 in the foot width direction while the first and second connecting portions 13 and 23 keep overlapping each other in the vertical direction.

Further, as shown in FIG. 5, the turnable range in which the first sole portion 10 turns relative to the second sole portion 20 is limited by the contact between the rear end portion ST1 of the first sole body 12 and the front end portion ST2 of the second connecting portion 23.

[Advantages of First Embodiment]

As described above, in the sole structure 1 according to the first embodiment, the first sole portion 10 is turnable around the connecting shaft 30 relative to the second sole portion 20 in the foot width direction. Thus, even if the wearer's foot has a shape curved in the foot width direction, turning of the first sole portion 10 allows the sole structure 1 to follow the shape of the wearer's foot without any resistance. As a result, the shoe S fits to the wearer's foot, and it becomes possible to keep the wearer from experiencing a sense of pressure from the shoe S.

Further, the first sole portion 10 turns while the first and second connecting portions 13 and 23 keep overlapping each other in the vertical direction. Thus, even if the first sole portion 10 is turned in the foot width direction, clearance between the first and second sole portions 10 and 20 is less likely to be formed. This configuration makes it difficult for foreign substances, water, or any other material to enter such clearance from the road surface or the ground. As a result, the wearer can safely and comfortably wear the shoe S.

Since the sole structure 1 includes the stopper mechanisms ST1 and ST2 configured to limit the turnable range of the first sole portion 10 or the second sole portion 20 around the connecting shaft 30, the turnable range of the first sole portion 10 is limited. This configuration stabilizes the shoe S, thereby making it comfortable to wear the shoe S. Further, since the stopper mechanisms ST1 and ST2 limit the turnable range by the first and second sole portions 10 and 20 coming into contact with each other, the sole structure 1 has a simple configuration. Such a simple configuration allows the wearer to comfortably wear the shoe S.

Second to fourth embodiments will now be described. In the following description, the same features as those in the first embodiment will not be described in some cases.

Second Embodiment

FIGS. 6 to 9 show a sole structure 1 according to a second embodiment of the present disclosure.

As shown in FIGS. 6 to 9, a first connecting portion 13 of a first sole portion 10 has a first elongate hole 15 extending in the foot length direction. The first elongate hole 15 is to be connected to a connecting shaft 30. The first elongate hole 15 passes through the first connecting portion 13 along the vertical direction. The first elongate hole 15 has a shape, the length of which in the foot length direction is greater than the length in the foot width direction. The first elongate hole 15 is formed through substantially the center of the first connecting portion 13 in the foot width direction. The first elongate hole 15 is covered with the first outsole portion 11 from below (see FIG. 7).

The first elongate hole 15 has a narrower upper opening 15*a*. A shaft portion 30*a* of the connecting shaft 30 is inserted into, and run through, the upper opening 15*a* along the vertical direction. The upper opening 15*a* is formed through substantially the center of the first elongate hole 15 in the foot width direction. The upper opening 15*a* has a shape, the length of which in the foot length direction is greater than the length in the foot width direction. The width of the upper opening 15*a* in the foot width direction is larger than the diameter of the shaft portion 30*a* of the connecting shaft 30. The width of the upper opening 15*a* in the foot width direction is smaller than the diameter of a retaining portion 30*b* of the connecting shaft 30.

The connecting shaft 30 is connected to the first elongate hole 15. Specifically, a lower portion of the shaft portion 30*a* of the connecting shaft 30 is inserted into, and run through, the opening 15*a* of the first elongate hole 15. The retaining portion 30*b* is accommodated in the first elongate hole 15 in a state in which the shaft portion 30*a* is inserted into, and run through, the opening 15*a* of the first elongate hole 15. Further, an upper surface of the retaining portion 30*b* is in contact with a lower periphery of the upper opening 15*a* of the first elongate hole 15.

Figure 8:
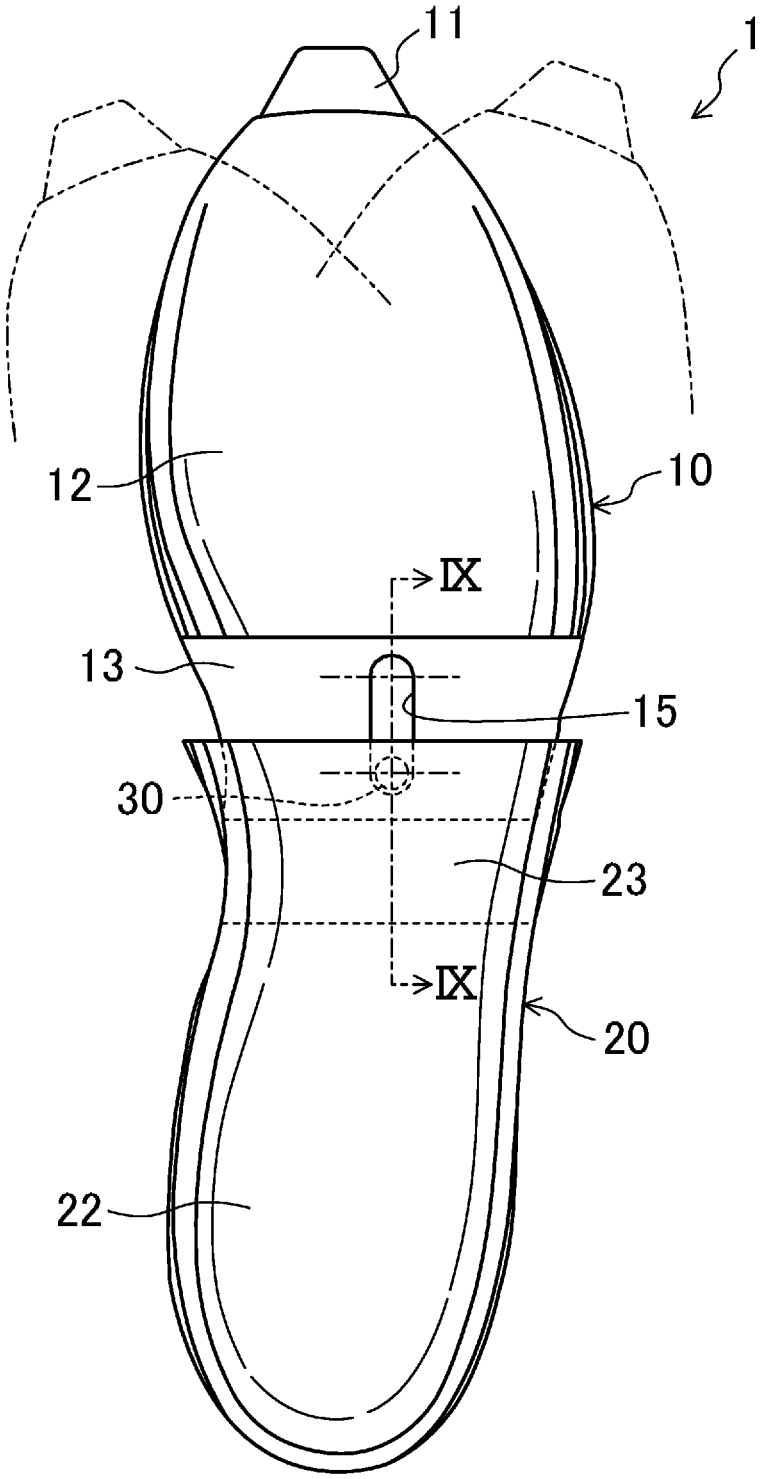
FIG. 8 is a plan view showing a state of the sole structure where a first sole portion of the sole structure moves relative to a second sole portion thereof in the foot length direction.
Figure 9:
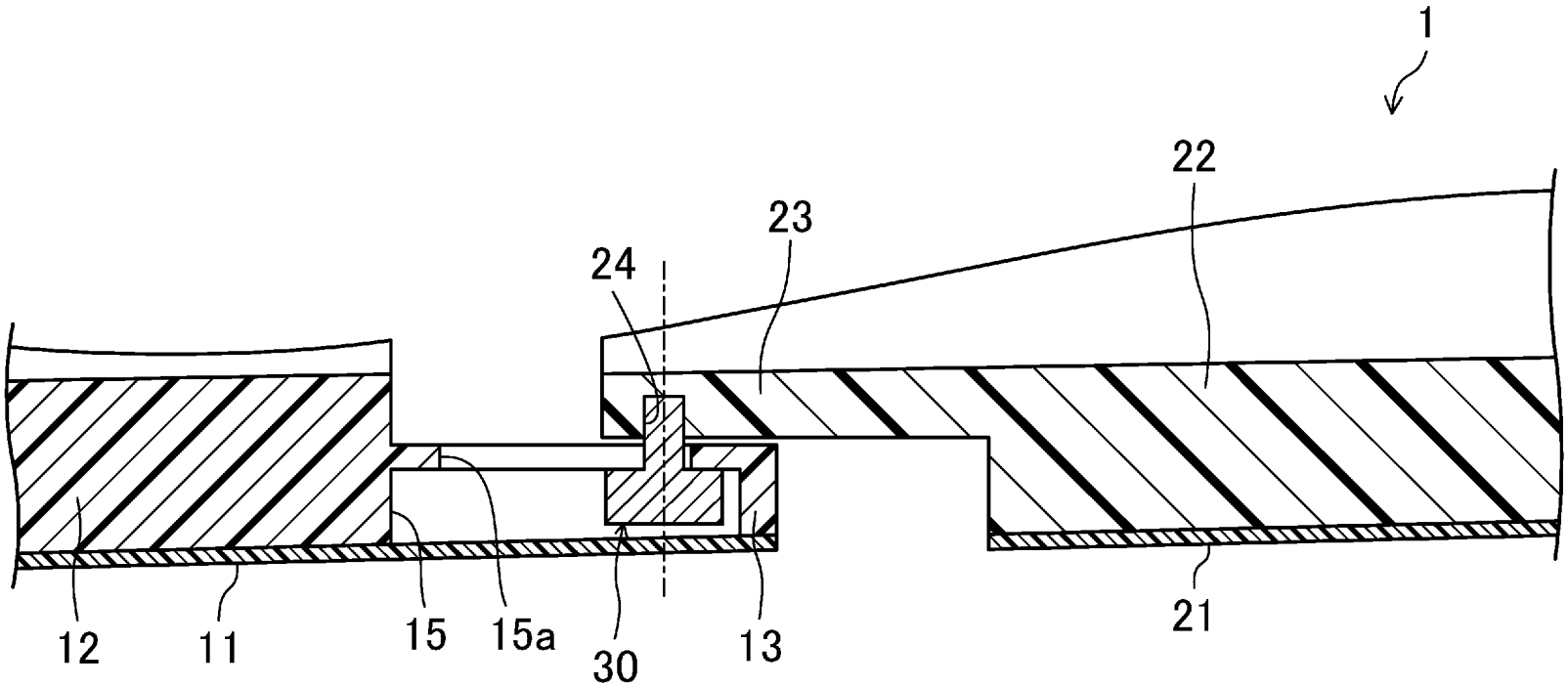
FIG. 9 is a cross-sectional view taken along line IX-IX shown in FIG. 8.
Figure 10:
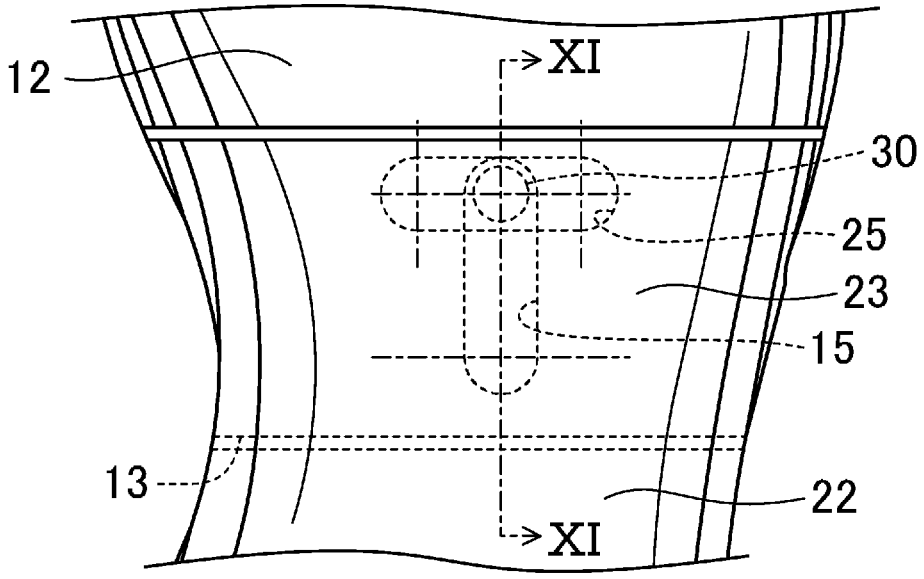
FIG. 10 is an enlarged plan view of a variation of the sole structure according to the second embodiment.

Just like the first embodiment, each of the first and second connecting portions 13 and 23 is configured to turn around the shaft portion 30*a* of the connecting shaft 30 in the foot width direction (see the phantom line in FIG. 8).

Sole Structure and Movements of Upper

Next, the sole structure 1 and movements of an upper 2 according to the second embodiment will be described.

Figure 6:
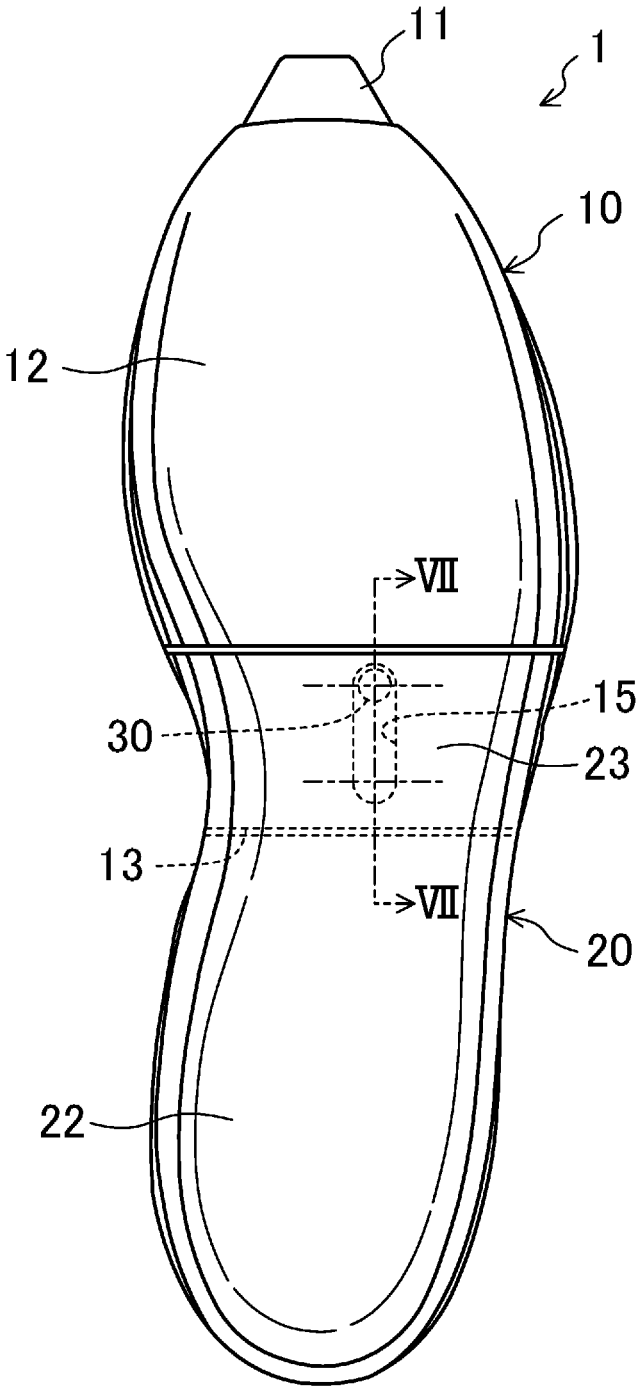
FIG. 6 corresponds to FIG. 3 and shows a sole structure according to a second embodiment.
Figure 7:
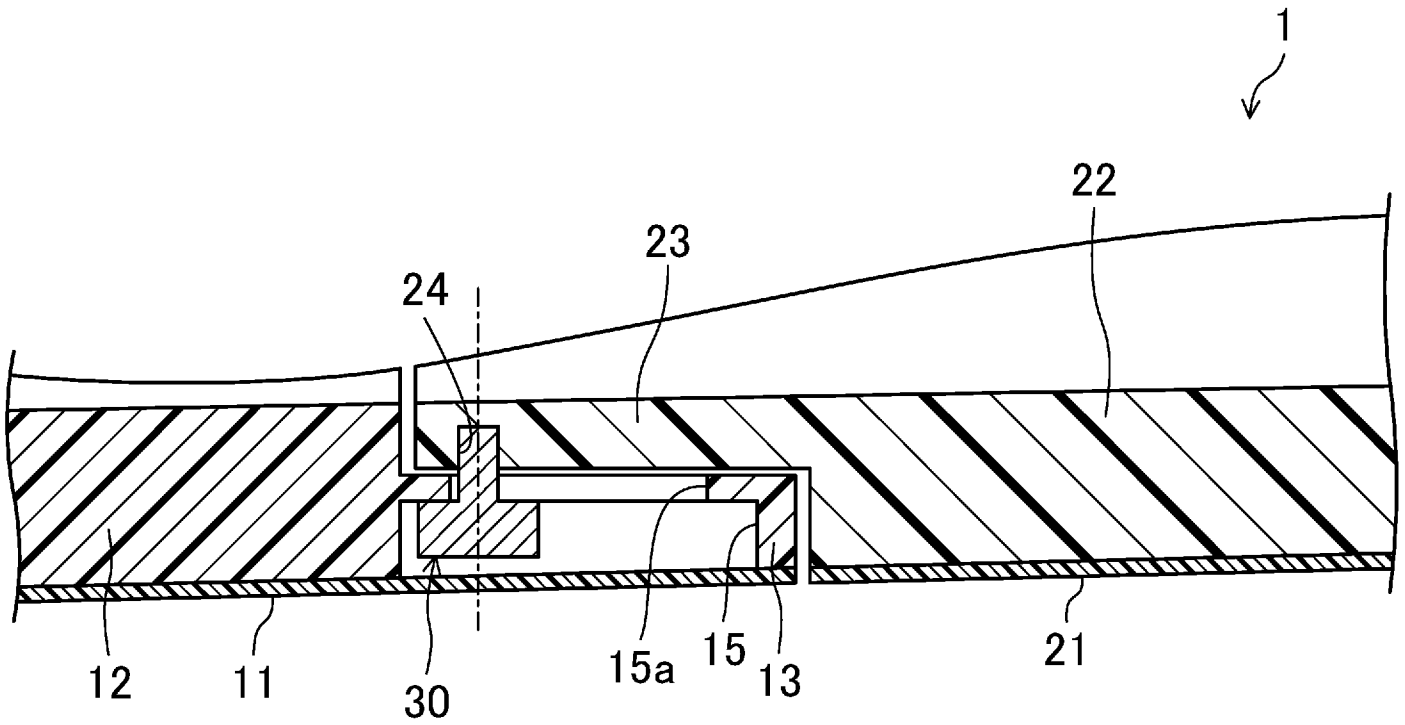
FIG. 7 is a cross-sectional view taken along line VII-VII shown in FIG. 6.

As shown in FIG. 6, in a state in which the first and second sole bodies 12 and 22 are close to each other in the foot length direction, substantially the entirety of the first connecting portion 13 and substantially the entirety of the second connecting portion 23 overlap each other in the vertical direction.

In the state shown in FIG. 6, if the wearer's foot is, for example, larger than the shoe S, a stretchable portion 2*b* of the upper 2 extends in accordance with the size of the foot of the wearer and a first fixing portion 2*c* thereof moves toward the front of the shoe S when the wearer puts on the shoe S. Accordingly, an external force toward the front of the shoe S is transferred to the first sole body 12 via the first fixing portion 2*c*. The external force allows the first sole body 12 to move away from the second sole body 22 in the foot length direction, and the first elongate hole 15 slides relative to the connecting shaft 30 in the foot length direction (see the solid line in FIG. 8).

If the wearer's foot, for example, is larger than the shoe S, and has a shape that is curved toward the medial side of the foot to a higher degree than the shape of the shoe S, the stretchable portion 2*b* of the upper 2 extends in accordance with the size and shape of the foot of the wearer and the first fixing portion 2*c* thereof moves toward the front and medial side of the shoe S when the wearer puts on the shoe S. Accordingly, an external force toward the front and medial side of the shoe S is transferred to the first sole body 12 via the upper 2. The external force allows the first sole body 12 to move away from the second sole body 22 in the foot length direction, and the first elongate hole 15 slides relative to the connecting shaft 30 in the foot length direction. Simultaneously, the first sole portion 10 turns around the connecting shaft 30 toward the medial side relative to the second sole portion 20 (see the phantom line in FIG. 8).

[Advantages of Second Embodiment]

As described above, in the sole structure 1 according to the second embodiment, the connecting shaft 30 is connected to the first elongate hole 15 extending in the foot length direction, and the first elongate hole 15 is slidable relative to the connecting shaft 30. Thus, the first sole portion 10 is movable relative to the second sole portion 20 in the foot length direction. Thus, since the first sole portion 10 turns around the connecting shaft 30 and moves in the foot length direction, the sole structure 1 has a higher degree of freedom in movement and can follow the shape of the wearer's foot without any resistance. As a result, the shoe S fits to the wearer's foot, and it becomes possible to keep the wearer from experiencing a sense of pressure from the shoe S.

<Variation of Second Embodiment>

In the second embodiment described above, the connecting shaft 30 is slidable only in the foot length direction. However, this is merely a non-limiting example. That is to say, as in a variation shown in FIGS. 10 to 13, the connecting shaft 30 may be slidable also in the foot width direction.

As shown in FIGS. 10 to 13, the second connecting portion 23 of the second sole portion 20 has a second elongate hole 25 extending in the foot width direction. The second elongate hole 25 is to be connected to the connecting shaft 30. The second elongate hole 25 passes through the second connecting portion 23 along the vertical direction. The second elongate hole 25 has a shape, the length of which in the foot width direction is greater than the length in the foot length direction. The second elongate hole 25 is formed through a portion of the second connecting portion 23 near the front end thereof. The second elongate hole 25 is covered with an insole or any other member from above (see FIG. 11). If no insole is provided, the second elongate hole 25 may be alternatively covered with a cover member (not shown).

The second elongate hole 25 has a narrower lower opening 25*a*. A shaft portion 30*a* of the connecting shaft 30 is inserted into, and run through, the lower opening 25*a* along the vertical direction. The lower opening 25*a* is formed through substantially the center of the second elongate hole 25 in the foot length direction. The lower opening 25*a* has a shape, the length of which in the foot width direction is greater than the length in the foot length direction. The width of the lower opening 25*a* in the foot length direction is larger than the diameter of the shaft portion 30*a* of the connecting shaft 30. The width of the lower opening 25*a* in the foot length direction is smaller than the diameter of an upper retaining portion 30*c* of the connecting shaft 30, which will be described below.

Figure 11:
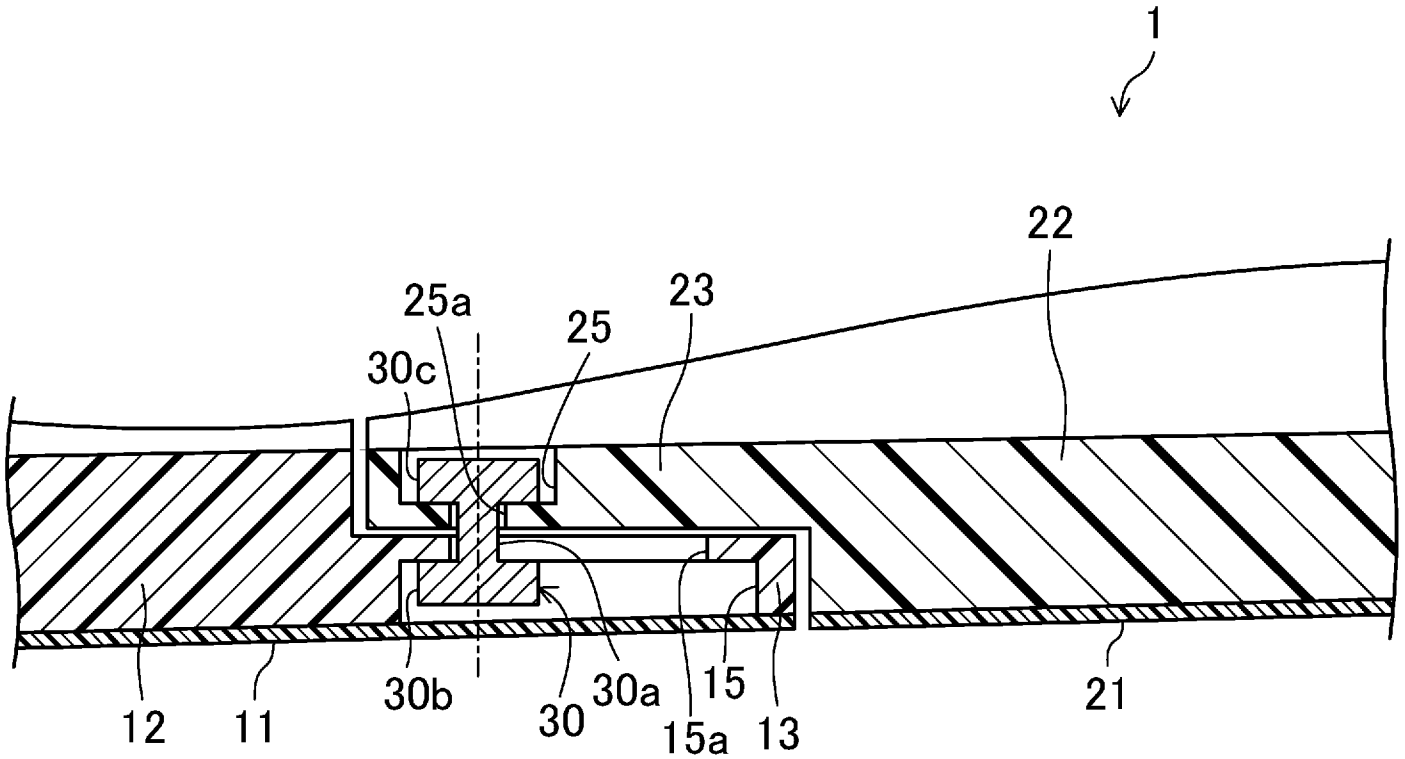
FIG. 11 is a cross-sectional view taken along line XI-XI shown in FIG. 10.
Figure 12:
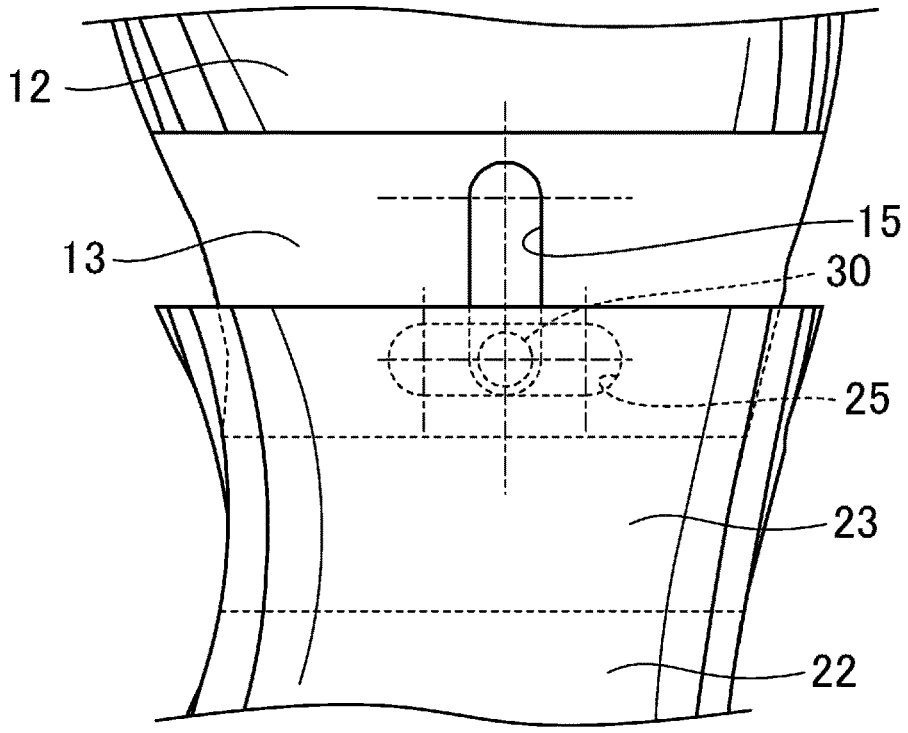
FIG. 12 is an enlarged plan view showing a state of the sole structure where a first sole portion of the sole structure moves relative to a second sole portion thereof in the foot length direction.
Figure 13:
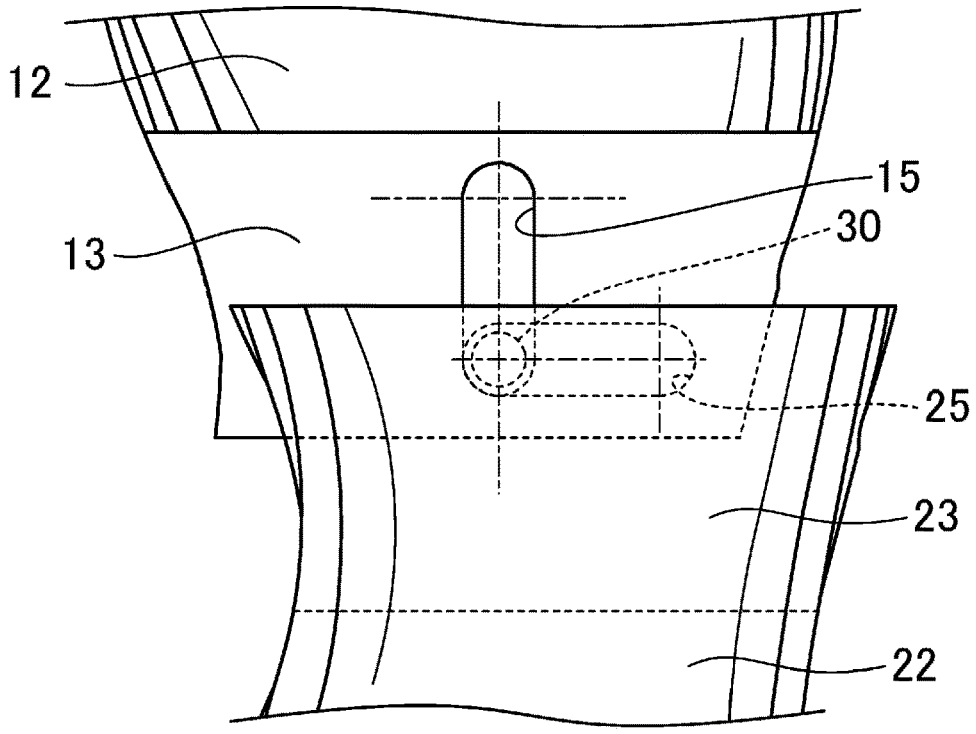
FIG. 13 is an enlarged plan view showing a state of the sole structure where the first sole portion moves relative to the second sole portion in the foot width direction.

The connecting shaft 30 is connected to the second elongate hole 25. Specifically, as shown in FIG. 11, the connecting shaft 30 includes the upper retaining portion 30*c* to be connected to the second elongate hole 25. The upper retaining portion 30*c* has substantially a disk-like shape, for example. The upper retaining portion 30*c* has a larger diameter than the shaft portion 30*a*. The retaining portion 30*c* is integrated with the shaft portion 30*a*. The upper retaining portion 30*c* is accommodated in the second elongate hole 25 in a state in which the shaft portion 30*a* is inserted into, and run through, the opening 25*a* of the second elongate hole 25. Further, a lower surface of the upper retaining portion 30*c* is in contact with an upper periphery of the opening 25*a* of the second elongate hole 25.

Just like the second embodiment, the second elongate hole 25 is slidable relative to the connecting shaft 30.

[Advantages of Variation of Second Embodiment]

In this variation, the connecting shaft 30 is connected to the second elongate hole 25 extending in the foot width direction, and the second elongate hole 25 is slidable relative to the connecting shaft 30. Thus, the first sole portion 10 is movable relative to the second sole portion 20 in the foot width direction. Thus, since the first sole portion 10 turns around the connecting shaft 30, moves in the foot length direction, and moves in the foot width direction in response to the sliding of the second elongate hole 25, the sole structure 1 has a higher degree of freedom in movement and can follow the shape of the wearer's foot without any resistance. As a result, the shoe S fits to the wearer's foot, and it becomes possible to keep the wearer from experiencing a sense of pressure from the shoe S.

Third Embodiment

Figure 14:
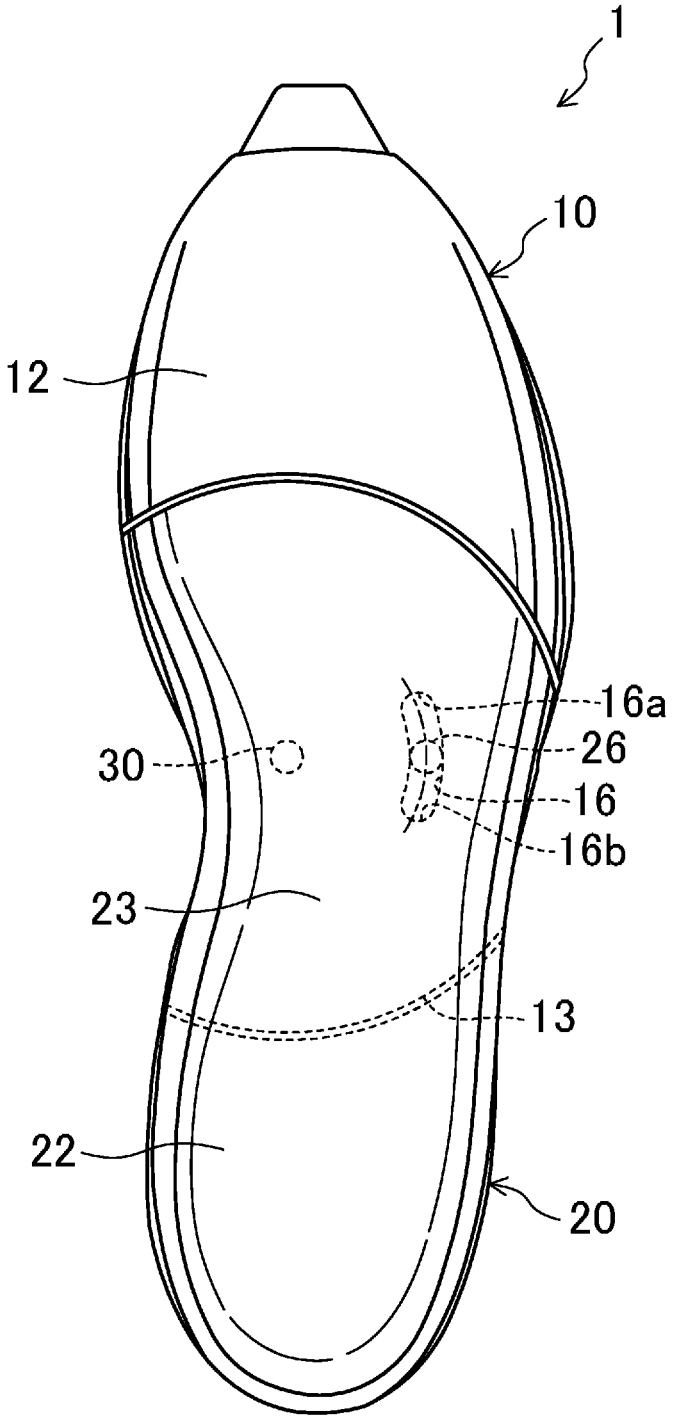
FIG. 14 corresponds to FIG. 3 and shows a sole structure according to a third embodiment.
Figure 15:
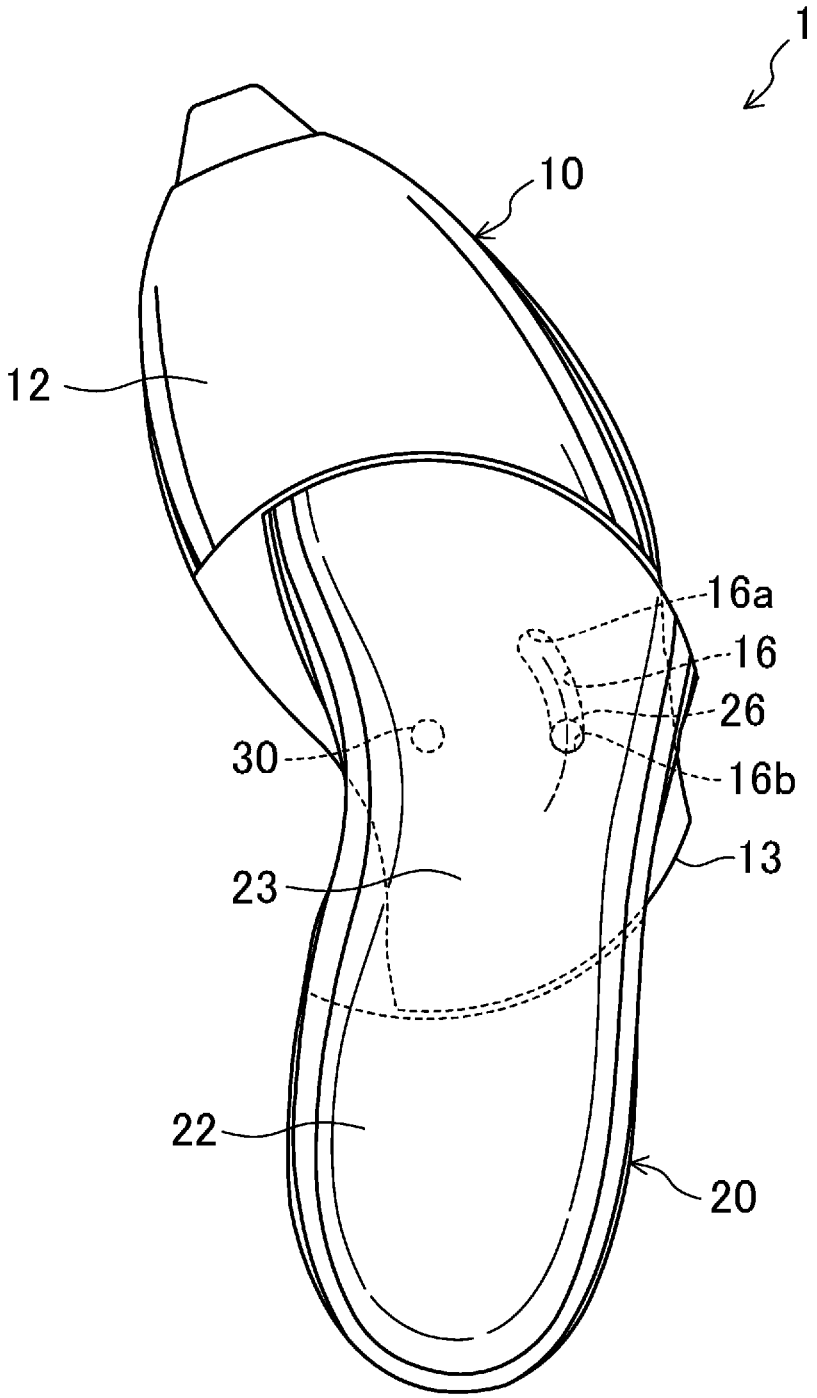
FIG. 15 is a plan view showing a state of the sole structure where a first sole portion of the sole structure turns relative to a second sole portion thereof toward a medial side thereof.
Figure 16:
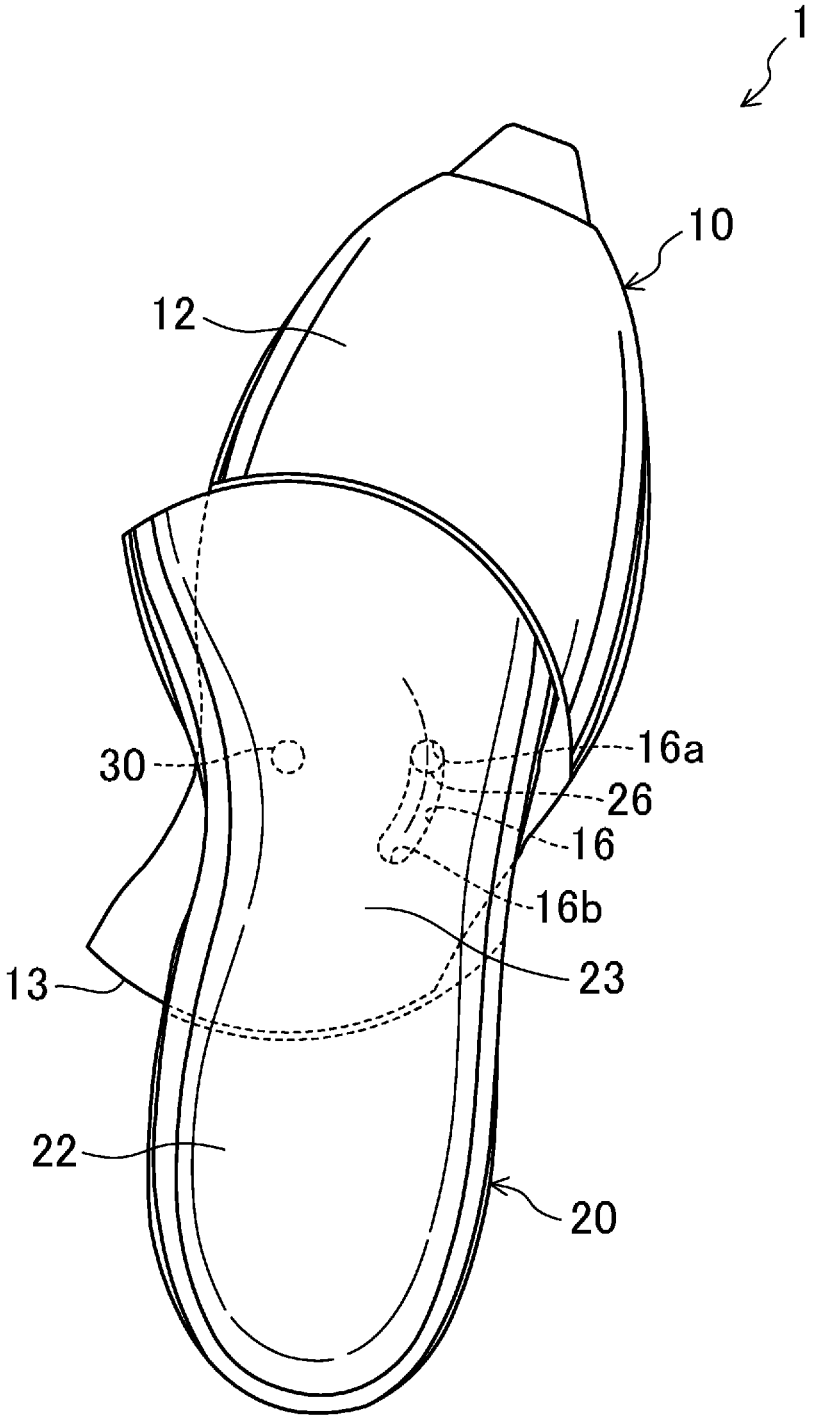
FIG. 16 is a plan view showing a state of the sole structure where the first sole portion turns relative to the second sole portion toward a lateral side of the sole structure.

FIGS. 14 to 16 show a sole structure 1 according to a third embodiment of the present disclosure.

As shown in FIGS. 14 to 16, a connecting shaft 30 is provided toward the medial side in the foot width direction at a position where first and second connecting portions 13 and 23 overlap each other. The second connecting portion 23 of the second sole portion 20 has a protrusion 26 at a position away from the position of the connecting shaft 30 toward the lateral side in the foot width direction, as viewed from above. The protrusion 26 protrudes downward of the second connecting portion 23.

The first connecting portion 13 of the first sole portion 10 has a third elongate hole 16 (a guide) configured to guide the protrusion 26. The third elongate hole 16 extends like an arc at a position away from the position of the connecting shaft 30 toward the lateral side in the foot width direction, as viewed from above. The width of the third elongate hole 16 is larger than the diameter of a distal end portion of the protrusion 26. The distal end portion of the protrusion 26 is fitted into the third elongate hole 16. Turning of the first sole portion 10 allows the protrusion 26 to slide through the third elongate hole 16.

The third elongate hole 16 has a front end portion 16*a* and a rear end portion 16*b*. When the first sole portion 10 turns, the protrusion 26 comes in contact with each of the end portions 16*a* and 16*b*, thereby limiting the turnable range of the first sole portion 10 (see FIGS. 15 and 16). That is to say, the protrusion 26 and these end portions 16*a* and 16*b* of the third elongate hole 16 are alternative embodiments of the stopper mechanisms described in the first embodiment.

To form a stopper mechanism, a groove that opens through the upper surface of the first connecting portion 13 may be formed instead of the third elongate hole 16.

[Advantages of Third Embodiment]

As described above, in the sole structure 1 according to the third embodiment, the protrusion 26 is fitted into the third elongate hole 16, and turning of the first sole portion 10 allows the protrusion 26 to slide through the third elongate hole 16. The protrusion 26 then comes into contact with one of the end portions 16*a* and 16*b* of the third elongate hole 16. That is to say, one of the end portions 16*a* and 16*b* of the third elongate hole 16 comes into contact with the protrusion 26 and serves as a stopper for stopping the sliding of the protrusion 26, thus limiting the turnable range of the first sole portion 10. In other words, the protrusion 26 and the end portions 16*a* and 16*b* of the third elongate hole 16 constitute a stopper mechanism configured to limit the turning of the first sole portion 10. The stopper mechanism stabilizes the shoe S, thereby making it comfortable to wear the shoe S. As a result, such a simple configuration allows the wearer to comfortably wear the shoe S.

Fourth Embodiment

Figure 17:
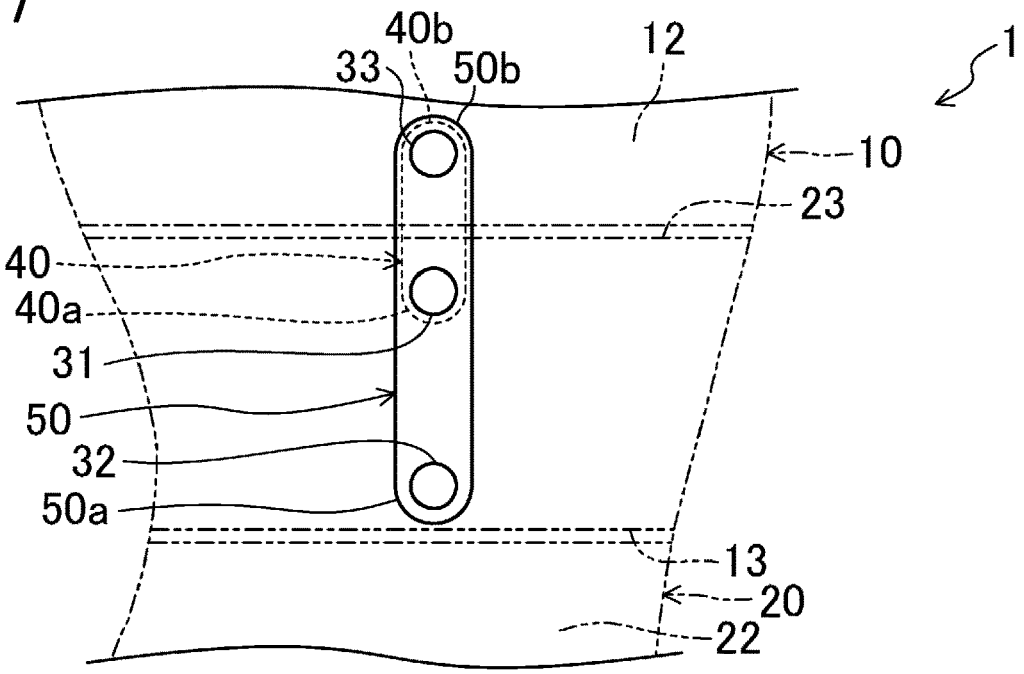
FIG. 17 is an enlarged plan view of a first position of first and second arms of a sole structure according to a fourth embodiment.
Figure 18:
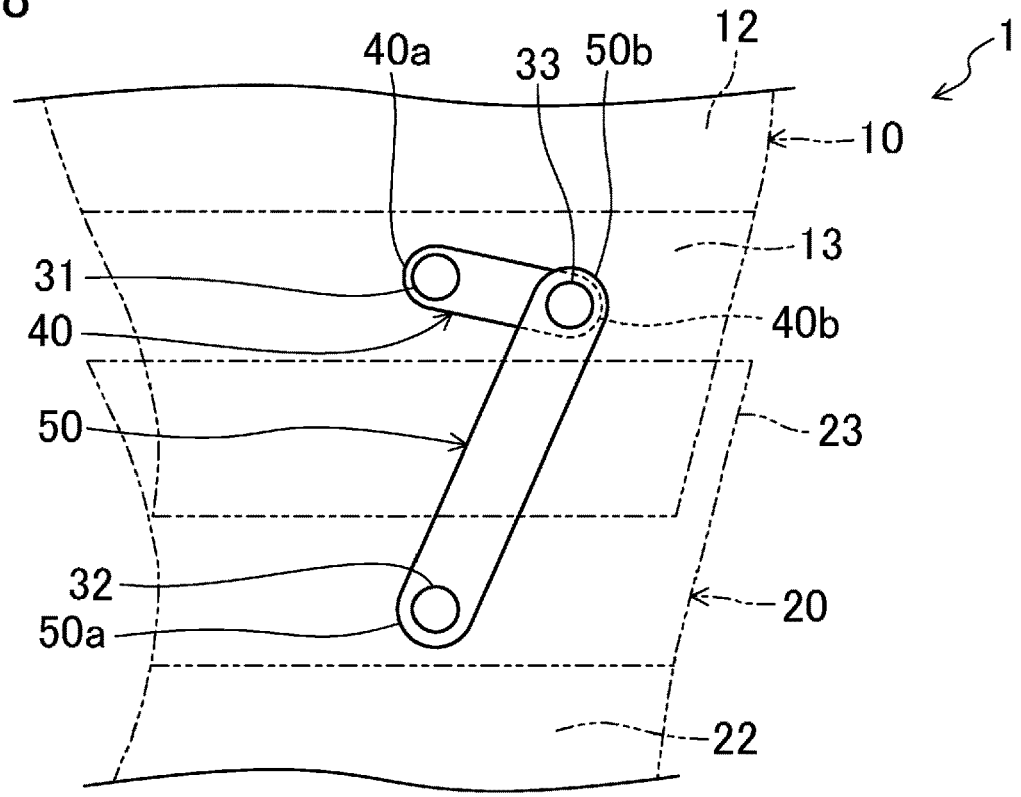
FIG. 18 is an enlarged plan view showing a state where the first and second arms of the sole structure according to the fourth embodiment are positioned between the first position and a second position.
Figure 19:
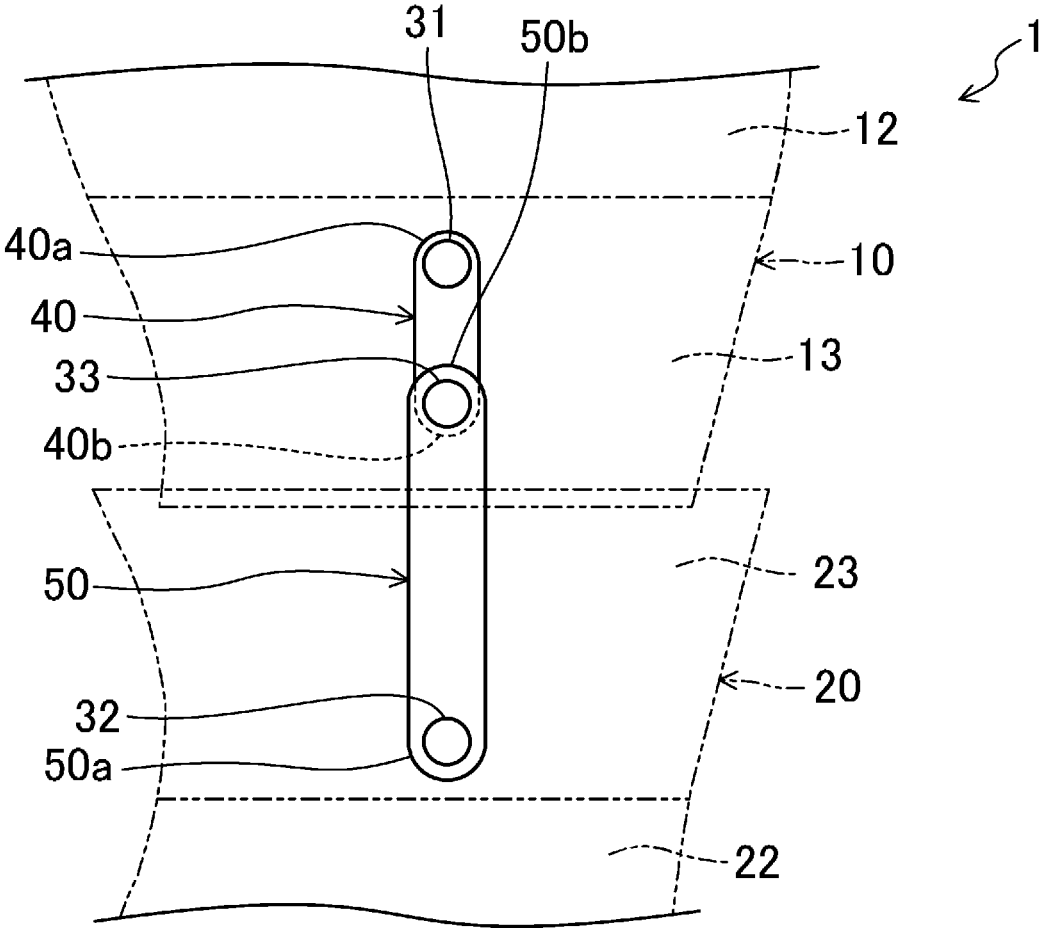
FIG. 19 is an enlarged plan view of the second position of the first and second arms of the sole structure according to the fourth embodiment.

FIGS. 17 to 19 show a sole structure 1 according to a fourth embodiment of the present disclosure.

As shown in FIGS. 17 to 19, the sole structure 1 includes a first arm 40 provided for the first connecting portion 13, and a second arm 50 provided for the second connecting portion 23.

The sole structure 1 includes a first connecting shaft 31, a second connecting shaft 32, and a third connecting shaft 33.

One end portion 40*a* of the first arm 40 is connected to the first connecting portion 13 to be turnable around the first connecting shaft 31, and one end portion 50*a* of the second arm 50 is connected to the second connecting portion 23 to be turnable around the second connecting shaft 32. The other end portion 40*b* of the first arm 40 and the other end portion 50*b* of the second arm 50 are connected together to be turnable around the third connecting shaft 33.

That is to say, the first sole portion 10 is turnable around the connecting shafts 31, 32, and 33 relative to the second sole portion 20.

As shown in FIGS. 17 to 19, the first and second arms 40 and 50 are displaceable between a first position in which they overlap each other in the vertical direction and a second position in which they are oriented in opposite directions, through the turning of the arms 40 and 50 around the connecting shafts 31, 32, and 33.

As shown in FIG. 17, in a state in which first and second sole bodies 12 and 22 are close to each other in the foot length direction, the first and second arms 40 and 50 overlap each other in the vertical direction (the first position).

In the state shown in FIG. 17, when the first sole body 12 moves away from the second sole body 22 relatively in the foot length direction, the angle formed by the first and second arms 40 and 50 increases due to the turning around the connecting shafts 31, 32, and 33 (see FIG. 18) from the first position, where they overlap each other, to cause the first and second arms 40 and 50 to be displaced to the position (second position) where the arms 40 and 50 are oriented in opposite directions (see FIG. 19).

In the state shown in FIG. 19, when the first sole portion 10 approaches the second sole portion 20 relatively in the foot length direction reversely to the foregoing movement, the angle formed by the first and second arms 40 and 50 decreases (see FIG. 18) from the second position, where the first and second arms 40 and 50 are oriented in opposite directions, to cause the arms 40 and 50 to be displaced to the first position where they overlap each other (see FIG. 17).

As described above, the first sole portion 10 is movable relative to the second sole portion 20 in the foot length direction by the turning of both the first and second arms 40 and 50.

[Advantages of Fourth Embodiment]

As described above, in the sole structure 1 according to the fourth embodiment, the one end portion 40*a* of the first arm 40 is connected to the first connecting portion 13 to be turnable around the first connecting shaft 31, and the one end portion 50*a* of the second arm 50 is connected to the second connecting portion 23 to be turnable around the second connecting shaft 32. Furthermore, the other end portions 40*b* and 50*b* of the first and second arms 40 and 50 are connected together to be turnable around the third connecting shaft 33. This configuration allows the first sole portion 10 to turn around the three connecting shafts 31, 32, and 33 relative to the second sole portion 20.

At least one of the turning of the first arm 40 around the first connecting shaft 31, the turning of the second arm 50 around the second connecting shaft 32, or the turning of the first and second arms 40 and 50 around the third connecting shaft 33 allows the first sole portion 10 to move away from, and approach, the second sole portion 20 in the foot length direction.

As can be seen, the sole structure 1 according to the fourth embodiment can be more freely deformed than a sole structure including a first sole portion 10 turnable around only one connecting shaft. The sole structure 1 according to the fourth embodiment therefore has a higher degree of freedom in movement and can follow the shape of the wearer's foot without any resistance. As a result, the shoe S fits to the wearer's foot, and it becomes possible to keep the wearer from experiencing a sense of pressure from the shoe S.

<Other Embodiments>

In the foregoing embodiments, the first sole portion 10 turns and moves relative to the second sole portion 20. However, this is merely a non-limiting example. In other words, the second sole portion 20 may turn and move relative to the first sole portion 10.

In the foregoing embodiments, the sole structure 1 has two portions separate from each other in the foot length direction. However, this is merely a non-limiting example. In other words, the sole structure 1 merely needs to have at least two portions separate from each other in the foot length direction.

In the foregoing embodiments, the first and second connecting portions 13 and 23 are connected together such that the upper surface of the first connecting portion 13 and the lower surface of the second connecting portion 23 face each other in the vertical direction. However, this is merely a non-limiting example. In other words, the upper surface of the second connecting portion 23 and the lower surface of the first connecting portion 13 may face each other in the vertical direction.

In the foregoing embodiments, the lower surface of the first sole body 12 and the lower surface of the first connecting portion 13 are flush with each other. However, this is merely a non-limiting example. In other words, the lower surface of the first sole body 12 and the lower surface of the first connecting portion 13 may not be flush with each other.

In the second embodiment, the first elongate hole 15 moves together with the first sole portion 10 moving in the foot length direction, and the connecting shaft 30 slides through the first elongate hole 15. However, this is merely a non-limiting example. In other words, the connecting shaft 30 may move together with the first sole portion 10 moving in the foot length direction and may slide through the first elongate hole 15.

In the third embodiment, the third elongate hole 16 moves together with the turning first sole portion 10, and the protrusion 26 slides through the third elongate hole 16. However, this is merely a non-limiting example. In other words, the protrusion 26 may move together with the turning first sole portion 10 and may slide through the third elongate hole 16.

In the fourth embodiment, when the first sole portion 10 is closest to the second sole portion 20, the first and second arms 40 and 50 overlap each other in the vertical direction, and the angle therebetween is 0 degrees. However, this is merely a non-limiting example. In other words, when the first sole portion 10 is closest to the second sole portion 20, the angle between the arms 40 and 50 may be greater than 0 degrees. For example, the angle between the arms 40 and 50 may be 90 degrees.

Note that the present disclosure is not limited to the embodiments described above, and various changes and modifications may be made without departing from the scope of the present disclosure.

The present disclosure is industrially applicable to, for example, a sole structure for athletic shoes for running and various sports, sneakers for daily use, or rehabilitation shoes and to shoes including the sole structure.

DESCRIPTION OF REFERENCE CHARACTERS

S Shoe
1 Sole Structure
10 First Sole Portion
12 First Sole Body
ST1 Rear End Portion of First Sole Body (Stopper Mechanism)
13 First Connecting Portion
15 First Elongate Hole
16 Third Elongate Hole (Guide)
16*a* Front End Portion of Third Elongate Hole (Stopper Mechanism)
16*b* Rear End Portion of Third Elongate Hole (Stopper Mechanism)
20 Second Sole Portion
22 Second Sole Body
23 Second Connecting Portion
ST2 Front End Portion of Second Connecting Portion (Stopper Mechanism)
25 Second Elongate Hole
26 Protrusion (Stopper Mechanism)
30 Connecting Shaft
31 First Connecting Shaft
32 Second Connecting Shaft
33 Third Connecting Shaft
40 First Arm
40*a* One End Portion of First Arm
40*b* Other End Portion of First Arm
50 Second Arm
50*a* One End Portion of Second Arm
50*b* Other End Portion of Second Arm

What is claimed is:

1. A sole structure for a shoe, the sole structure comprising:

a first sole portion including a first sole body and a first connecting portion provided behind the first sole body;

a second sole portion disposed behind the first sole portion and including a second sole body and a second connecting portion provided in front of the second sole body; and a connecting shaft provided along a direction perpendicular to a surface of the first connecting portion so as to connect the first connecting portion and the second connecting portion together, either one of the first sole portion or the second sole portion being freely turnable around the connecting shaft relative to the other one of the first sole portion or the second sole portion in a foot width direction, and the connecting shaft being freely turnable relative to at least one of the first connecting portion and the second connecting portion.

2. The sole structure of claim 1, further comprising:

a stopper mechanism configured to limit a turnable range around the connecting shaft by the first sole portion and the second sole portion coming into contact with each other.

3. The sole structure of claim 1, wherein at least one of the first connecting portion or the second connecting portion has a first elongate hole extending in a foot length direction, and the connecting shaft is slidably connected to the first elongate hole.

4. The sole structure of claim 1, wherein at least one of the first connecting portion or the second connecting portion has a second elongate hole extending in the foot width direction, and the connecting shaft is slidably connected to the second elongate hole.

5. The sole structure of claim 2, wherein either one of the first connecting portion or the second connecting portion has a protrusion spaced apart from the connecting shaft in the foot width direction as viewed from above, the protrusion protruding vertically, the other one of the first connecting portion or the second connecting portion has a guide configured to guide the protrusion through turning of the first sole portion or the second sole portion, and the turnable range of the first sole portion or the second sole portion is limited by the protrusion coming into contact with one of both end portions of the guide.

6. The sole structure of claim 1, further comprising:

a first arm provided for the first connecting portion; and a second arm provided for the second connecting portion, wherein the connecting shaft includes a first connecting shaft, a second connecting shaft, and a third connecting shaft, one end portion of the first arm is connected to the first connecting portion to be turnable around the first connecting shaft, one end portion of the second arm is connected to the second connecting portion to be turnable around the second connecting shaft, the other end portion of the first arm and the other end portion of the second arm are connected together to be turnable around the third connecting shaft, and either one of the first sole portion or the second sole portion is turnable around the connecting shafts relative to the other one of the first sole portion or the second sole portion in the foot width direction, and is movable relative to the other one in the foot length direction.

7. The sole structure of claim 1, wherein the first connecting portion and the second connecting portion are connected together while overlapping each other in the vertical direction, and either one of the first sole portion or the second sole portion turns relative to the other one of the first sole portion or the second sole portion in the foot width direction while the first connecting portion and second connecting portion keep overlapping each other in the vertical direction.

8. A shoe comprising the sole structure of claim 1.
9. A shoe comprising the sole structure of claim 2.
10. A shoe comprising the sole structure of claim 3.
11. A shoe comprising the sole structure of claim 4.
12. A shoe comprising the sole structure of claim 5.
13. A shoe comprising the sole structure of claim 6.
14. A shoe comprising the sole structure of claim 7.

* * * * *